US007793478B2

(12) United States Patent
Ehsani

(10) Patent No.: US 7,793,478 B2
(45) Date of Patent: Sep. 14, 2010

(54) FIBER REINFORCED POLYMER ROOF STRENGTHENING METHOD

(76) Inventor: Mohammad R. Ehsani, P.O. Box 64757, Tucson, AZ (US) 85728-4757

( * ) Notice: Subject to any disclaimer, the term of this patent is extended or adjusted under 35 U.S.C. 154(b) by 795 days.

(21) Appl. No.: 11/424,040

(22) Filed: Jun. 14, 2006

(65) Prior Publication Data

US 2006/0283138 A1 Dec. 21, 2006

Related U.S. Application Data

(60) Provisional application No. 60/691,876, filed on Jun. 20, 2005.

(51) Int. Cl.
*E04B 5/00* (2006.01)
*E04B 1/00* (2006.01)
*E04G 21/00* (2006.01)

(52) U.S. Cl. ..... 52/409; 52/411; 52/741.1; 52/745.21; 52/746.11; 52/748.1

(58) Field of Classification Search ..... 52/748.1, 52/408–413, 746.11
See application file for complete search history.

(56) References Cited

U.S. PATENT DOCUMENTS 1,284,997 A * 11/1918 Bigler ..... 52/105
2,099,093 A * 11/1937 Avery ..... 427/186
3,992,842 A 11/1976 Haage et al.
4,227,356 A 10/1980 Stern et al.
4,452,848 A 6/1984 Geiger
4,475,765 A 10/1984 Vogt et al.
4,483,117 A 11/1984 Underhill et al.
4,587,164 A 5/1986 Freeman
4,783,942 A 11/1988 Nunley et al.
5,218,793 A * 6/1993 Ball ..... 52/62
5,253,461 A * 10/1993 Janoski et al. ..... 52/408

(Continued)

*Primary Examiner*—Brian E Glessner
*Assistant Examiner*—Omar Hijaz
(74) *Attorney, Agent, or Firm*—QuickPatents, Inc.; Kevin Prince

(57) ABSTRACT

A method of strengthening a roof is disclosed. Preferably, the roof is first cleaned of at least some of any existing roofing materials to expose at least a portion of a roof deck, which is also preferably cleaned. A layer of high viscosity resin may then be rolled or brushed onto the roof deck. Once the roof has been adequately prepared, a plurality of strips of composite material may be provided and saturated with a low-viscosity saturating resin. Each such saturated strip is preferably long enough to fit along an entire first side of the roof, the first such strip hanging partially over the first side of the roof. Each end of the first strip also overhangs the roof. A second saturated strip is then placed generally parallel to and overlapping the first strip. The ends of this second strip likewise overhang two sides of the roof. Successive strips are saturated in the saturating resin and applied to the roof in a similar manner, until no further strips can be applied to the roof without completely covering the roof with strips. A last strip is then similarly applied to the roof, each end thereof overhanging the two opposing sides of the roof, and one long side of the strip overhanging the remaining uncovered side of the roof. Upon the saturating resin drying sufficiently to be somewhat rigid, each overhanging portion of each strip is anchored to at least one of the walls at the top portion thereof with an anchoring means. A method for using a spray-on cut fiber and resin material is also disclosed.

20 Claims, 2 Drawing Sheets

U.S. PATENT DOCUMENTS

| | | | | |
|---|---|---|---|---|
| 5,309,685 | A | 5/1994 | Rathgeber et al. | |
| 5,469,671 | A | 11/1995 | Rathgeber et al. | |
| 5,584,153 | A | 12/1996 | Nunley et al. | |
| 5,640,825 | A * | 6/1997 | Ehsani et al. | 52/746.1 |
| 5,916,093 | A | 6/1999 | Fecko et al. | |
| 5,988,074 | A | 11/1999 | Thoman | |
| 6,393,797 | B1 * | 5/2002 | Romes | 52/746.1 |
| 6,490,834 | B1 | 12/2002 | Dagher | |
| 6,931,813 | B2 | 8/2005 | Collie | |
| 6,981,349 | B1 * | 1/2006 | Martinez, Jr. | 52/409 |
| 7,178,306 | B2 * | 2/2007 | Fritz | 52/746.11 |
| 7,299,599 | B2 * | 11/2007 | Swann | 52/746.11 |
| 2002/0170254 | A1 * | 11/2002 | Ritland et al. | 52/408 |
| 2003/0024174 | A1 * | 2/2003 | Bonds et al. | 52/79.1 |
| 2003/0145546 | A1 * | 8/2003 | Georgeau et al. | 52/408 |
| 2004/0172899 | A1 * | 9/2004 | Paradise et al. | 52/302.1 |
| 2006/0174552 | A1 * | 8/2006 | Nocito | 52/95 |

* cited by examiner

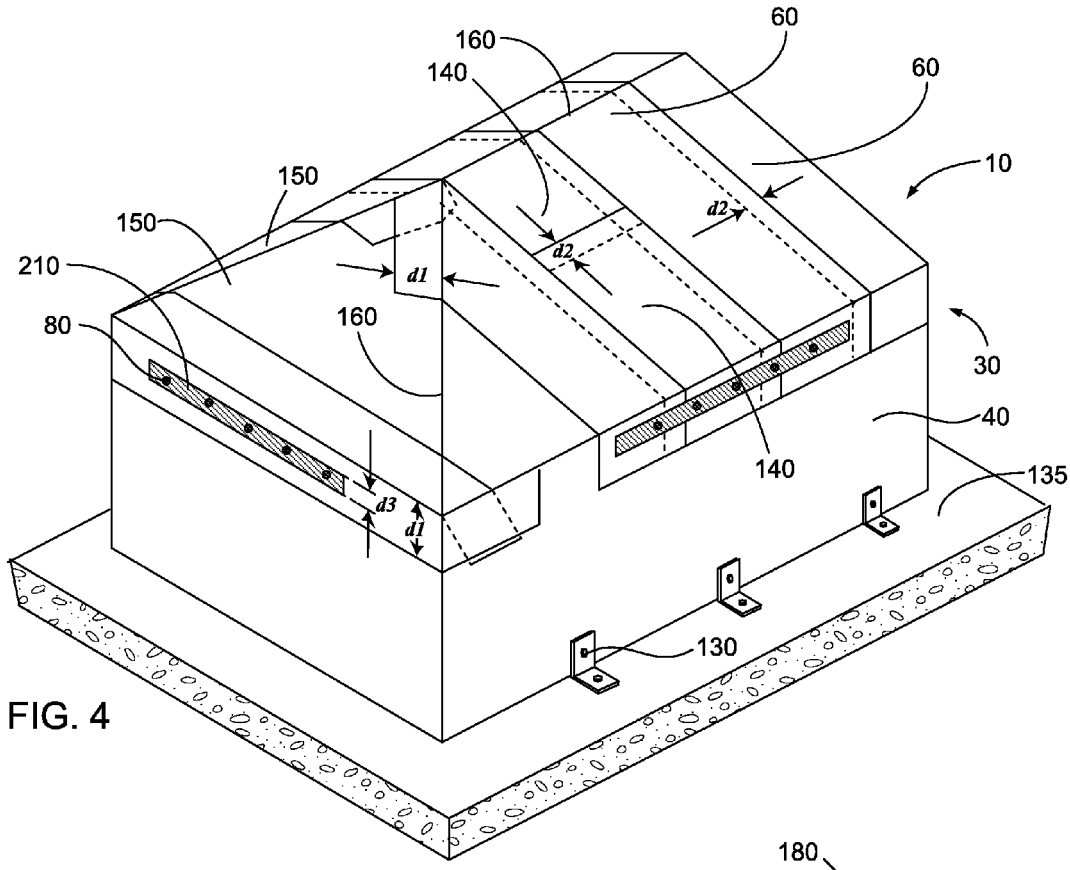
FIG. 4
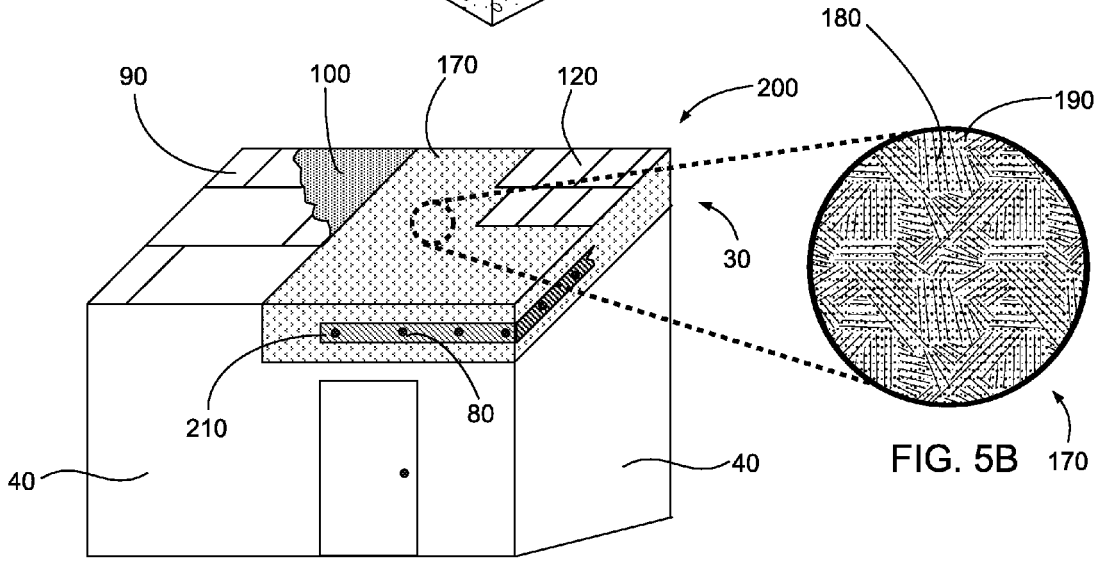
FIG. 5B
FIG. 5A

FIBER REINFORCED POLYMER ROOF STRENGTHENING METHOD

CROSS-REFERENCE TO RELATED APPLICATIONS

This application claims the benefit of U.S. Provisional Patent Application 60/691,876, filed on Jun. 20, 2005.

STATEMENT REGARDING FEDERALLY SPONSORED RESEARCH AND DEVELOPMENT

Not Applicable.

FIELD OF THE INVENTION

This invention relates to roof construction, and more particularly to a fiber-reinforced polymer roof strengthening method.

DISCUSSION OF RELATED ART

This invention relates generally to the strengthening and waterproofing of roofs, and in particular to increasing the strength of a roof to resist high wind, earthquake or blast loadings using fiber reinforced polymer (FRP) products to create a seamless cover for the roof, effectively rendering the roof as one single, watertight section. The method can be applied in construction of new roofs as well as to existing roofs as a retrofit technique. During high-wind storms, such as hurricanes and tornadoes, the upward force of the wind often causes sections of the sheathing located beneath the roof covering to be ripped off and thrown into the air. This loss of roof sheathing allows water intrusions and also severely weakens the overall structure of the roof. Surveys have shown that between 50 and 70 percent of hurricane losses are caused by roof failures or water intrusions through damaged roofs. Billions of dollars are spent each year repairing structures and replacing such damaged property.

For typical homes constructed in North America, the sheathing of the roof consists of plywood or Oriented Strand Board (OSB). The most commonly cited causes for loss of roof sheathing in a high-wind storm are poor fastener spacing, over-driven nails, or nails not contacting the support structure. While building codes regulating these features do exist, builders often misunderstand the regulations or fail to adhere to them. The difficulty of performing comprehensive inspections in the field makes enforcing the code challenging.

In addition to these problems, the effectiveness of a roof in its primary purpose, namely to protect the interior of a structure from the weather, can also be improved. Even if a roof is not overtly leaking, moisture seepage can cause difficulties such as mold and mildew, resulting in property damage and health problems. One common method of waterproofing a roof is covering it with a laminated roofing material that includes an aluminum foil top sheet laminated to a polyethylene film by an ionomer resin. The main disadvantage of the aluminum-faced membranes is the low mechanical resistance of the coating on the exposed face. The aluminum film is extremely thin (about 35 to 50 micrometers), and is commonly subject to mechanical damage, which in turn may expose the asphalt-based portion of the membrane to the UV solar rays and water from rain and snow.

Mechanical roof ties, such as those disclosed in U.S. Pat. No. 6,931,813 to Collie on Aug. 23, 2005, may be well-suited for holding one section of roof sheathing to a vertical wall of a structure, but such a device does not effectively tie the entire roof together as one integral piece or unit. Similarly, U.S. Pat. No. 6,490,834 to Dagher on Dec. 10, 2002 teaches a means of securing roof and wall sheathing panels together. But such a device does not essentially create an integrated roof unit, since sheathing panel seams are still mechanically separated from each other.

By placing a sufficiently overlapping series of fiber reinforced polymer fabric strips over the entire roofing structure and securing it to the wall of the structure, all of the above-mentioned problems can be mitigated. Anchoring the fabric to the wall causes much less strain to be placed on the fasteners holding down the plywood sheathing, resulting in fewer failures. Inspection of the roofing structure is also much simplified. Once hardened, these fabric strips act effectively as a single unit, eliminating the possibility of sections of the roof sheathing becoming loose during a high-wind storm and becoming separated from the rest of the structure. In addition, this sealed, single layer creates a completely waterproof barrier between the exterior and the interior of a structure. My previous U.S. Pat. No. 5,640,825 issued on Jun. 24, 1997, teaches a similar method to the present invention, but is applicable towards protection sections of vertical walls. This improved method overcomes many of the disadvantages of the prior art.

Therefore, there is a need for a means of strengthening both flat and sloped roofs through the use of resin-impregnated fabric sheets. Such a needed method would essentially create a single integrated roof structure that could not easily become separated, even partially, from the building structure to which it is applied. The needed invention would be easy to apply to roofs of virtually any geometric configuration, and would require relatively inexpensive materials. Further, the needed invention would allow additional protective coatings or roofing materials to be applied thereon without damage. The present invention accomplishes these objectives.

SUMMARY OF THE INVENTION

The present invention is a method of strengthening a roof. With both flat and sloped roofs, commonly found in commercial, industrial and residential buildings, each has a peripheral edge fixed to a top portion of a plurality of walls. Preferably, the roof is first cleaned of at least some of any existing roofing materials to expose at least a portion of a roof deck, which is also preferably cleaned. A layer of high viscosity resin may then be rolled or brushed onto the roof deck.

Once the roof has been adequately prepared, a plurality of strips of composite material may be provided and saturated with a low-viscosity saturating resin. Each such saturated strip is preferably long enough to fit along an entire first side of the roof, the first such strip hanging partially over the first side of the roof. Each end of the first strip also overhangs the roof. A second saturated strip is then placed generally parallel to and overlapping the first strip. The ends of this second strip likewise overhang two sides of the roof.

Alternately, if strips are not available that are long enough to traverse the roof from one side to an opposing side, each strip may be comprised of a plurality of strip sections, each section being generally longitudinally coincident to and overlapping each adjacent strip section. Each strip section is applied to the roof in succession to form the strip.

Next, successive strips are saturated in the saturating resin and applied to the roof in a similar manner, until no further strips can be applied to the roof without completely covering the roof with strips. At this point, a last strip is similarly applied to the roof, each end thereof overhanging the two opposing sides of the roof, and one long side of the strip overhanging the remaining uncovered side of the roof.

With a roof having at least two non-coplanar roof sections, each roof section forms a ridge along a line of contact with each adjacent roof section. Consequently, in application of the present method to such a roof, each end of each strip either overhangs a side of the roof section to which it is applied, or it overhangs at least one adjacent roof section, partially covering the ridge. Upon the saturating resin drying sufficiently to be somewhat rigid, each overhanging portion of each strip is anchored to at least one of the walls at the top portion thereof with an anchoring means.

As wind or other forces applied to the roof will, after application of the present method, be transferred substantially to the walls of the structure, an additional step of further securing each wall mechanically to a foundation of the structure with a foundation securing means may also be performed.

The present method is a means of strengthening both flat and sloped roofs through the use of resin-impregnated fabric sheets. The present invention essentially creates a single integrated roof structure that cannot easily become separated, even partially, from the building structure to which it is applied. The method is easy to apply to roofs of virtually any geometric configuration, and requires only relatively inexpensive materials. Further, the present invention allows additional protective coatings or roofing materials to be applied thereon without damaging the resin-impregnated fabric sheets. Other features and advantages of the present invention will become apparent from the following more detailed description, taken in conjunction with the accompanying drawings, which illustrate, by way of example, the principles of the invention.

DESCRIPTION OF THE DRAWINGS

FIG. 4 is a perspective view of a roof having a plurality of non-coplanar roof sections, illustrating the application of the roof strengthening method of the invention thereon;

FIG. 5A is a perspective view of a sloped roof, illustrating the application of an alternate embodiment of the roof strengthening method of the invention thereon; and FIG. 5B is a close-up view of a mixture of chopped fiber and resin.

DETAILED DESCRIPTION OF THE PREFERRED EMBODIMENT

Figure 1:
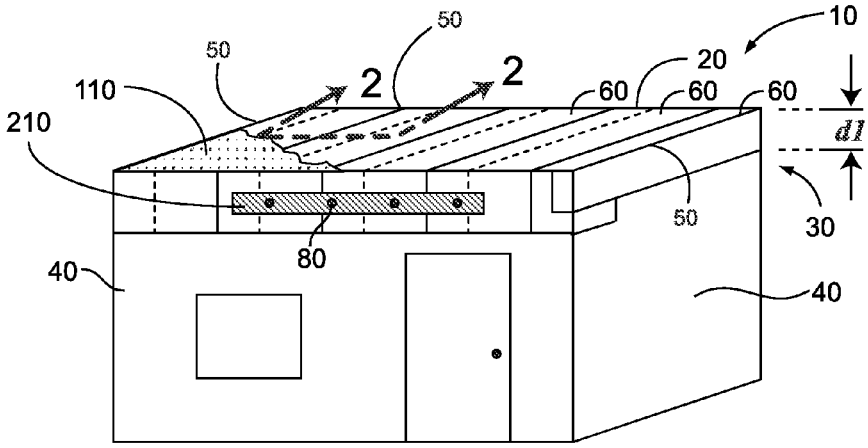
FIG. 1 is a perspective view of a flat roof, illustrating the application of a roof strengthening method of the invention thereon.

A method of strengthening a roof 10 is disclosed. With reference to FIG. 1, which depicts a flat roof 10, and with reference to FIG. 3, which depicts a sloped roof 10, the preferred method of the present invention is similarly performed. With both flat and sloped roofs 10, commonly found in commercial, industrial and residential buildings, each has a peripheral edge 20 fixed to a top portion 30 of four walls 40. Any number of walls 40 greater than two, however, applies to the method of the present invention, the roof 10 in such situations having a number of sides 50 differing than four as illustrated by way of example herein.

Figure 3:
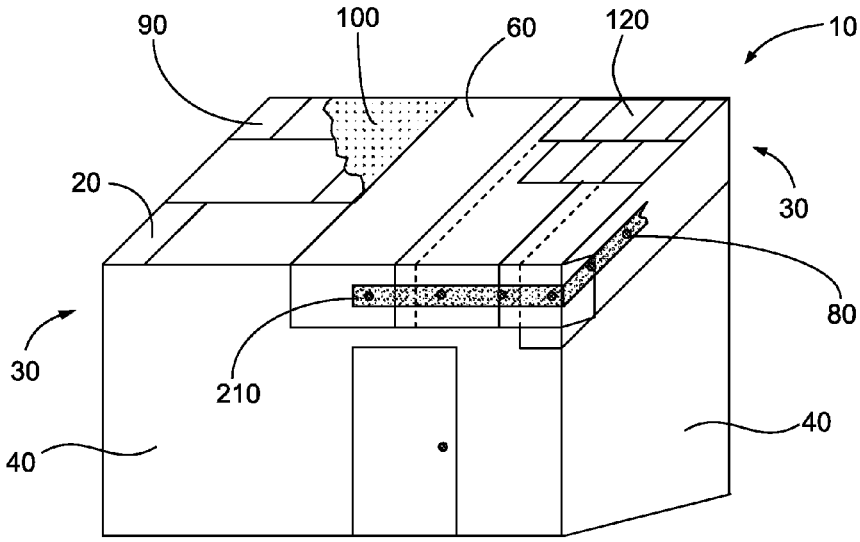
FIG. 3 is a perspective view of a sloped roof, illustrating the application of the roof strengthening method of the invention thereon.

Preferably, the roof 10 is first cleaned of at least some of any existing roofing materials (not shown) to expose at least a portion of a roof deck 90 (FIG. 3). Such a roof deck 90 may also be cleaned, which will make subsequent resin applications bond more effectively. Further, a layer of high viscosity resin 100 may then be rolled or brushed onto the roof deck 90, as illustrated in FIG. 3. Such a high-viscosity resin 100 may be glue, epoxy, or resins such as those sold by QuakeWrap, Inc. under the brand names QuakeBond™ J200TC and QuakeBond™ J201TC, for example. In this disclosure, the term epoxy shall mean epoxies, polyesters, vinyl esters, and other polymer-based liquid adhesive products.

Figure 2:
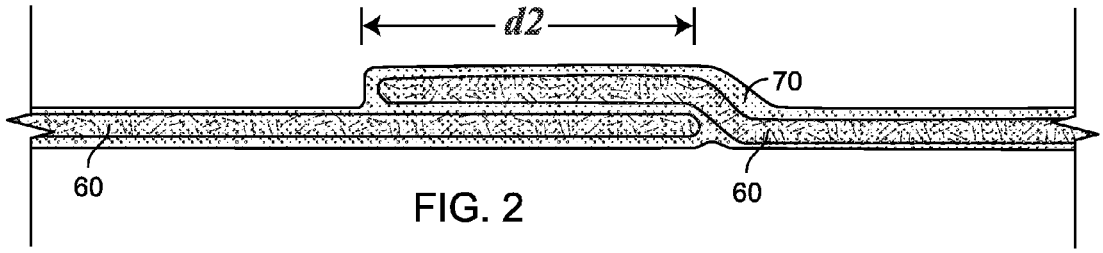
FIG. 2 is a cross-sectional view, taken across lines 2-2 of FIG. 1, of a strip of composite material saturated in a saturating resin and overlapping by at least a distance d2.

Once the roof 10 has been adequately prepared, a plurality of strips 60 of composite material, such as fiber reinforced polymer fabric strips 60, may be provided. Each strip 60 is either a unidirectional or multidirectional construction, such as those sold by QuakeWrap, Inc. model# VU20G, VB24G, or TB24C. The fibers used in the strips 60 may be any suitable metallic or non-metallic fiber, either natural or synthetic. For example, glass, carbon, Kevlar®, and the like are well-suited for such use. It has been found that 50 inch wide rolls of the strip material are suitable for effective coverage and ease of handling. Each strip 60 is, in the preferred embodiment of the method, saturated with a low-viscosity saturating resin 70 (FIG. 2), such as that sold by QuakeWrap, Inc. under the brand name QuakeBond™ J300SR, for example. Such a saturating resin 70 both bonds each strip 60 to the roof 10 and also creates a water-impermeable layer to protect the roof 10 from weather.

The first such saturated strip 60 is preferably long enough to fit along an entire first side 50 of the roof 10, the strip 60 hanging partially over the first side 50 of the roof 10 by a minimally effective overhanging distance d1, which has been found to be approximately twelve inches for most roofs 10, but can range anywhere from four inches to twenty-four inches depending upon the type of roof 10 being reinforced. Each end of the first strip 60 also overhangs the roof by at least the minimally effective overhanging distance d1.

A second saturated strip 60 is then provided, the second strip 60 being placed generally parallel to and overlapping the first strip 60 by at least a minimally effective overlapping distance d2, preferably between six and twelve inches. The ends of this second strip 60 likewise overhang two sides 50 of the roof 10 (FIGS. 1 and 3). When bending each strip 60 around one of the sides 50 of the roof 10, the resulting corner are rounded to a curvature sufficiently large, such as ¾ to one inch radius, to avoid breaking of the fibers of the strip 60.

Alternately, if strips 60 are not available that are long enough to traverse the roof 10 from one side 50 to an opposing side 50, each strip 60 may be comprised of a plurality of strip sections 140, each section 140 being generally longitudinally coincident to and overlapping each adjacent strip section 140 by at least the distance d2 (FIG. 4). Each strip section 140 is applied to the roof 10 in succession to form the strip 160.

Next, successive strips 60 are saturated in the saturating resin 70 and applied to the roof 10 in a similar manner, until no further strips 60 can be applied to the roof 10 without completely covering the roof 10 with strips 60. At this point, a last strip 60 is similarly applied to the roof 10, each end thereof overhanging the two opposing sides 50 of the roof 10 by at least the distance d2, and one long side of the strip 60 overhanging the remaining uncovered side 50 of the roof 10 by at least the distance d1.

With a roof 10 having at least two non-coplanar roof sections 150, such as that illustrated in FIG. 4, each roof section 150 forms a ridge 160 along a line of contact with each adjacent roof section 150. Consequently, in application of the present method to such a roof 10, each end of each strip 160 either overhangs a side 50 of the roof section 150 to which it is applied, or it overhangs at least one adjacent roof section 150 by the distance d1, partially covering the ridge 160. Clearly, for the purposes of the present method, ridges 160 may be either upward-pointing ridges 160 as shown, or downward-pointing valleys (not shown).

Upon the saturating resin 70 drying sufficiently to be somewhat rigid, each overhanging portion of each strip 60 is anchored to at least one of the walls 40 at the top portion 30 thereof with an anchoring means 80. The anchoring means 80 may be an adhesive, such as the high-viscosity resin 100, or mechanical fasteners such as steel angles and bolts, or a combination of the two. Clearly, other suitable anchoring means 80 may be devised that would be suitable for use in the present method, the use of such anchoring means 80 not departing from the spirit and scope of the present invention. The strips 60 and the resin 70 dry together to form a rigid encasement 200 (FIG. 5), functionally a one-piece roof 10.

Instead of using strips 60, an alternate embodiment of the invention provides a mixture 170 of fibers 180 and liquid resin 190. Such a mixture 170 is sprayed onto the roof 10 to completely cover the roof 10. In such an embodiment, the mixture 170 is also sprayed onto each top portion 30 of each wall 40, from the top of each wall 40 down to at least the distance d1. The mixture 170 is allowed to dry sufficiently and then it is anchored to each wall with the anchoring means 80, as heretofore described, or with a strengthening band 210 (FIG. 4) fixed around a perimeter of the structure. The strengthening band 210 may be applied such that it overhangs the roof 10 and each top portion 30 of each wall 40 by a minimally effective band overhanging distance d3, preferably between 6 to 24 inches.

To provided enhanced durability for the roof 10 against ultraviolet rays, UV-resistant chemicals may be added to the resin 70 before saturating the strips 60. Alternately, the finished roof 10 may be painted or otherwise coated with a UV-resisting coating, preferably every five to seven years. In addition thereto, or in place thereof, particles of grit 110 may be additionally applied to the top of each strip 60 before the saturating resin 70 dries. Such particles of grit 110 may be sand, 3M's "Roofing Granules," or other particles 110 that will adhere to the roof 10 to create a physical barrier against exposure of the resin 70 to UV rays. Additionally, a sacrificial coating of resin 70 may be applied to the roof 10, and/or conventional shingles or other roof surfaces 120 (FIG. 3).

To provide a roof 10 with additional fire resistance, additives such as hydrated alumina may be added to the resin 70 or the resin 110. The other roof surfaces 120 applied to the roof 10 over the strips 60 may further be fire-resistant shingles or tiles (FIG. 3).

As wind or other forces applied to the roof 10 will, after application of the present method, be transferred substantially to the walls 40 of the structure, an additional step of further securing each wall 40 mechanically to a foundation 135 of the structure with a foundation securing means 130 may also be performed. Such foundation securing means 130 may be metal L-brackets and bolts, or the like (FIG. 4).

While a particular form of the invention has been illustrated and described, it will be apparent that various modifications can be made without departing from the spirit and scope of the invention. For example, the strips 60 may be set diagonally on the roof 10 as opposed to parallel with one side 50 of the roof 10. Further, other roof 10 configurations or geometries not specifically mentioned may be covered with the method of the present invention. Accordingly, it is not intended that the invention be limited, except as by the appended claims.

What is claimed is:

1. A method of strengthening a roof, the roof being fixed proximate a peripheral edge thereof to a top portion each of at least two walls, the roof defined by at least three sides, the method comprising the steps of:

(a) providing a strip of composite material sufficiently long to extend beyond a first side of the roof to beyond a second side of the roof;

(b) saturating the strip of composite material with a saturating resin;

(c) placing the strip over at least three sides of the roof, the strip hanging partially over the first side of the roof, the second side of the roof, and a third side of the roof by at least a predetermined overhanging distance;

(d) repeating steps (a) and (b) with a second strip, and placing the second strip generally parallel to and overlapping by at least a predetermined overlapping distance the first strip, the second strip hanging partially over the first side of the roof and the second side of the roof by at least the predetermined overhanging distance;

(e) repeating steps (a) and (b) with successive strips, and placing each successive strip generally parallel to and overlapping by at least the predetermined overlapping distance the previously applied strip, each successive strip hanging partially over the first side of the roof and the second side of the roof by at least the predetermined overhanging distance, until no further strips can be applied to the roof without completely covering the roof with strips;

(f) repeating steps (a) and (b) with a last strip, and placing the last strip generally parallel to and overlapping by at least the predetermined overlapping distance the next most recently applied strip, the last strip hanging partially over each of the first side of the roof, the other second side of the roof, and the remaining uncovered side of the roof by at least the predetermined overhanging distance;

(g) forming a rigid encasement by allowing said strips and said saturating resin to dry together; and (h) anchoring the overhanging portions of each strip to the top portion of at least one of the walls with an anchoring means, thereby allowing forces applied to the roof to be transferred substantially to said at least one of the walls.

2. The method of claim 1 further including the step of: (a') removing at least some existing roofing materials before step (a) to expose at least a portion of a roof deck.

3. The method of claim 2 further including the step of: (a") cleaning the surface of the roof deck before step (a').

4. The method of claim 1 further including the step of: (a"') applying a layer of high viscosity resin to the roof before step (a).

5. The method of claim 1 further including the step of: (f') applying particles of grit on top of the strips before the saturating resin on each strip dries.

6. The method of claim 5 wherein steps (f') and (h) are interchanged.

7. The method of claim 1 further including the step of: (i) applying an additional roof surface over the strips.

8. The method of claim 1 further including the step of: (g'): further securing each wall mechanically to a foundation with a foundation securing means.

9. The method of claim 1 wherein each strip is comprised of a plurality of strip sections, each section being generally longitudinally coincident to and overlapping each adjacent strip section by at least the predetermined overlapping distance, each strip section being applied to the roof in succession to form the strip.

10. A method of strengthening a roof, the roof being fixed proximate a peripheral edge thereof to a top portion each of at least two walls, the roof including at least two non-coplanar roof sections, each roof section forming a ridge along a line of contact with each adjacent roof section, each section defined by at least three sides, the method comprising the steps of:

(a) providing a strip of composite material sufficiently long to extend beyond a first side of one of the roof sections to beyond a second side of the one roof section;

(b) saturating the strip of composite material with a saturating resin;

(c) placing the strip over at least three sides of the one roof section, the strip hanging partially over the first side of the one roof section, the second side of the one roof section, and a third side of the one roof section by at least a predetermined overhanging distance;

(d) repeating steps (a) and (b) with a second strip, and placing the second strip generally parallel to and overlapping by at least a predetermined overlapping distance the first strip, the second strip hanging partially over the first side of the one roof section and the second side of the one roof section by at least the predetermined overhanging distance;

(e) repeating steps (a) and (b) with successive strips, and placing each successive strip generally parallel to and overlapping by at least the predetermined overlapping distance the previously applied strip, each successive strip hanging partially over the first side of the one roof section and the second side of the one roof section by at least the predetermined overhanging distance, until no further strips can be applied to the one roof section without completely covering the one roof section with strips;

(f) repeating steps (a) and (b) with a last strip, and placing the last strip generally parallel to and overlapping by at least the predetermined overlapping distance the next most recently applied strip, the last strip hanging partially over each of the first side of the one roof section, the second side of the one roof section by at least the predetermined overhanging distance, the last strip at least partially covering the ridge between the one roof section and at least one adjacent roof section and covering at least a portion of each adjacent roof section by at least the predetermined overlapping distance;

(g) forming a rigid encasement by allowing said strips and said saturating resin to dry together;

(h) repeating steps (a) through (g) for each roof section; and (i) anchoring the overhanging portions of each strip to the top portion of at least one of the walls with an anchoring means, thereby allowing forces applied to the roof to be transferred substantially to said at least one of the walls.

11. The method of claim 10 further including the step of: (a') removing at least some existing roofing materials before step (a) to expose at least a portion of a roof deck.

12. The method of claim 11 further including the step of: (a") cleaning the surface of the roof deck before step (a').

13. The method of claim 10 further including the step of: (a'") applying a layer of high viscosity resin to each roof section before step (a).

14. The method of claim 10 further including the step of: (f') applying particles of grit on top of the strips before the saturating resin on each strip dries.

15. The method of claim 10 further including the step of: (j) applying an additional roof surface over the strips.

16. The method of claim 10 further including the step of: (h'): further securing each wall mechanically to a foundation with a foundation securing means.

17. The method of claim 10 wherein each strip is comprised of a plurality of strip sections, each section being generally longitudinally coincident to and overlapping each adjacent strip section by at least the predetermined overlapping distance, each strip section being applied to one roof section in succession to form the strip.

18. The method of claim 1 wherein the predetermined overhanging distance is at least four inches and the predetermined overlapping distance is at least six inches.

19. The method of claim 10 wherein the predetermined overhanging distance is at least four inches and the predetermined overlapping distance is at least six inches.

20. A method of strengthening a roof, the method comprising the steps of: forming a rigid encasement, said rigid encasement sized to cover said roof and a portion of each of a plurality of walls to which said roof is fixed; and mounting said rigid encasement to at least one of said walls to allow forces applied to said roof to be transferred substantially to said walls;

wherein said forming further comprises:

saturating a plurality of strips of fiber-reinforced composite material with a low viscosity saturating resin;

overlapping said plurality of strips to cover said roof and said portion of each of the plurality of walls to which said roof is fixed; and allowing the strips and the saturating resin to dry together to form said rigid encasement;

wherein said mounting further comprises:

anchoring one or more of said strips to a top portion of at least one of the walls with an anchoring means.

* * * * *